United States Patent [19]

Bene

[11] Patent Number: 4,905,457

[45] Date of Patent: Mar. 6, 1990

[54] APPARATUS FOR WRAPPING A GENERALLY CYLINDRICAL ARTICLE IN A THERMALLY WELDABLE WEB

[75] Inventor: Armand Bene, Saint Priest, France

[73] Assignee: Madinox S.A., Saint Priest, France

[21] Appl. No.: 316,758

[22] Filed: Feb. 28, 1989

[30] Foreign Application Priority Data

Aug. 18, 1987 [FR] France ..... 87 11917

[51] Int. Cl.[4] ..... B65B 11/06; B65B 59/00

[52] U.S. Cl. ..... 53/504; 53/168; 53/228; 53/553; 53/389

[58] Field of Search ..... 53/168, 210, 204, 228, 53/553, 504, 66, 389

[56] References Cited

U.S. PATENT DOCUMENTS 3,776,081 12/1973 Becker ..... 53/168 UX
3,815,313 6/1974 Heisler ..... 53/168 X
4,047,359 9/1977 Gronebaum ..... 53/553 X
4,075,815 2/1978 Carver, Jr. et al. ..... 53/228 X
4,167,841 9/1979 Camp ..... 53/228 X
4,413,463 11/1983 Lancaster ..... 53/228 X

FOREIGN PATENT DOCUMENTS 7306978 9/1974 France .

*Primary Examiner*—James F. Coan
*Attorney, Agent, or Firm*—Herbert Dubno

[57] ABSTRACT

A machine for wrapping cylindrical articles in a thermally weldable web has an automatic changeover system for webs of different widths in response to the detection of articles of different lengths. The system automatically guides the free end of a new web downwardly by a deflector connected to the upper jaw member of a double-welding system in which pairs of electrodes are energized to form two seams when successive articles are to be wrapped with the same web but where a new web is to be used, only a single seam is formed and the clamped end of the previously used web is cut away while the balance of the previously used web is rolled up again.

7 Claims, 5 Drawing Sheets

APPARATUS FOR WRAPPING A GENERALLY CYLINDRICAL ARTICLE IN A THERMALLY WELDABLE WEB

FIELD OF THE INVENTION

My present invention relates to an apparatus or machine for wrapping a cylindrical product or article in a thermally weldable web, e.g. a foil or film of a synthetic resin, e.g. a shrink wrap film or the like.

More particularly, the invention relates to a machine or apparatus for this purpose which permits a wrapping of cylindrical objects or articles, stacks of disk-shaped articles, axially aligned cylindrical packs or stacks consisting of numerous pieces, or, more generally, an elongated article or array of articles having an axis, in a weldable layer (hereinafter "web") which can be wrapped around the article and can be fed in a direction enabling it to pass around the periphery of the article so as to form a kind of sheath around the latter.

BACKGROUND OF THE INVENTION

French Pat. No. 2,219,060 (SOBREAL) describes a process for effecting this type of wrapping which generally comprises the steps of:

unrolling and feeding a thermally weldable web from at least one roll of the web material;

feeding the product to be wrapped against the taut web;

pressing the product perpendicularly to the path of the web so that the article will entrain the web and the web will wrap around the article;

effecting on the web two parallel welds, the first connecting the ends of the stretch of the web surrounding the article and the second being spaced from the first and connecting stretches of the web supplied to the wrapping location and a stretch of web by which the web was tensioned; and cutting the web between the two weld seams.

In this wrapping method, the weld seam proximal to the article closes the sheath while the other weld seam, formed with spacing from the first and more remote from the article, serves to join the stretches of the web separated from the sheath by the cutting operating into a single stretch so that the next article can be pressed thereagainst and the process repeated.

The web is thus wrapped around each product and nevertheless has the separated portions formed upon liberation of the packaged product from the web in a substantially continuous state so that another length can be drawn off to wrap the next product or article.

French Pat. No. 2,219,060 also describes a machine for carrying out this process and comprising principally:

a feeder for advancing the articles to be wrapped;

one or more rolls of a thermally weldable web carried by an upper portion of the machine;

a fixed double-jaw lower welding member;

a vertically movable upper double-jaw welding member;

a cutting tool associated with one of the welding members;

a roller deflector around which the web passes in the course of unrolling from one of the rolls; and a draw-down device located below the lower welding member and serving to draw the end of the web formed by the small lost portion of the latter downstream of the cutting action at each wrapping operation;

the second weld here holds this lost portion to the oncoming portion of the web.

The machine also provided with means for receiving and supporting the article during the course of wrapping.

In the use of machines of this type, one can feed cylindrical products of various lengths to be wrapped. If the machine is equipped at its upper portion with a plurality of rolls of the web, it is easy to see that the rolls can carry webs of different widths adapted to wrap, for example, products to two or three different lengths.

While the machine as described can be operated effectively for wrapping articles of a uniform length, problems are encountered upon a change in length of the product to be wrapped since the supply of a web of a width different from a previous web width poses problems.

Because of the manner in which the described machine functions, the transition between one web width and other web width requires that the web previously unrolled be rolled back up and that the new web be unrolled.

In practice this operation has been effected manually and represents a costly intervention in the automatic operation of the machine because of the time required for the manual changeover.

Up to the present time, the problem of automating the changeover of the web has not been resolved at least in part because of difficulties encountered in guiding the free end of a web to be unrolled or to be rolled back up.

Because the web, especially when it is a film, has a very light free end, even ordinary air currents are capable of deflecting the web or deforming it and prevent it from arriving at the desired location in the machine when the web is fed without guidance.

Of course, it is possible to imagine that one can grip the free end of the web in pincers or the like and draw it with such pincers along the desired path.

However, such devices are highly complex, costly and prone to failure. The problem is all the more acute since it is necessary to provide pincers with a variable spacing to adapt to the different widths of the web to be used.

OBJECTS OF THE INVENTION

It is the principal object of the present invention to provide an improved machine of the type described which is free from the drawbacks enumerated above.

Another object of this invention is to provide a machine for wrapping elongated, generally cylindrical articles of various widths in succession which can automatically effect a changeover from one web to another without any manual intervention for the changeover operation and which, therefore, satisfactorily solves problems hitherto encountered in the guiding of the web.

SUMMARY OF THE INVENTION

The machine according to the invention is able to satisfy these objects by providing the double-welding jaws and the cutting tool so that they are able to form either two spaced-apart parallel welds separated by a cut in the case in which the same web or film is used for wrapping successive products or articles, or is capable of forming only a single weld and a cut between this weld and free ends of the oncoming web and the waste stretch, thereby liberating the web adapted to the roll used for wrapping the preceding article so that this web can be rolled up and a length of web unrolled form another roll of different width for wrapping a subsequent article or product.

More specifically, the machine according to the invention can comprise:

support;

means on an upper portion of the support for holding a plurality of rolls of a thermally weldable web;

means below the upper portion for feeding generally cylindrical articles in succession to a wrapping location;

a lower double-jaw welding member mounted fixedly on the support at the location;

an upper double-jaw welding member mounted for vertical movement on the support and juxtaposed with the lower member so that upon movement of the upper member toward the lower member pairs of jaws of the members clamp the web between them at two spaced apart strips;

means for selectively energizing at least one of the jaws of each pair individually and together to form selectively two welds along the respective strip and a single weld along a respective one of the strips proximal to an article being wrapped;

cutting means on one of the members for cutting the webs between the strips;

deflecting-roll means on the support between the upper portion and the location around which the web can pass to the location;

drawing means on the support below the location for engagement with the web for holding same across a path of the articles between the means for feeding and the lower member; and means on the support at the location for receiving and supporting each article in the course of wrapping same, whereby the web is deflected around each articles as it is displaced between the members from the means for feeding onto the means for receiving and supporting, whereby two welds are formed at the strips and the web is cut between the welds when the web from one of the rolls is to wrap a succession of the articles, but only a single weld is formed at one of the strips proximal to an article being wrapped and the web is cut between the strips when a successive article is to be wrapped with the web from another one of the rolls.

When two successive products or articles have the same length, therefore, the machine is used in the known manner to provide a double weld and a cut between the welds following envelopment of the article in the film for the first article and before envelopment of the second or next article.

By contrast, if two successive products having different lengths are to be wrapped with different webs of respective widths, after envelopment of the first article, only a single weld is provided and the cut is formed between this weld and the oncoming web to separate the wrapped article. The web stretch connected to the roll is thus not joined by a second weld seam to the last part engaged in the draw-down device. Thus this web is free and can be rolled up. Then another web of different width, adapted to the length of the following product, can be unrolled.

In a preferred embodiment of the invention, the double-jaw upper welding member, movable vertically, carries a deflector for guiding this web.

This jaw and its deflector are lowered during changing of the web so as to accompany the descent of the free end of the new web and thereby guide the latter in a precise manner without the risk of deflection of the free end of the web by an air current.

In order to facilitate the roll up of a preceding web and the unrolling of the new web, the invention provides that a pivotal deflector flap is disposed between the feeder and the lower fixed double-jaw welding member, this deflector being tilted during a changing of the web.

The deflector roller assembly can comprise movable rollers which during the wrapping operation form a looped path for the web but during the threading of the new web into the machine can be swung upwardly to permit a free passage to the free end of the new web and, of course, to remove any complex path upon rerolling of a prior web.

Advantageously, the web rolls are carried by a carriage movable horizontally on the upper portion of the machine frame, a motor being provided to effect unrolling or rerolling of one or more of the rolls to pay out or retract the respective web.

Preferably the apparatus can comprise means for automatic detection of the lengths of the cylindrical products arriving at the article feeder, means for automatically selecting the roll of the web which is to be supplied to the wrapping location in response to the detected length of the product, and means for automatically sequencing the machine for changeover of the web.

The machine of the invention thus can effect automatic changeover of the web used to wrap the products each time such a changeover is necessary because of a change in the length of the products to be wrapped as each arrives when the machine must serve to wrap products of different lengths.

The changeover of the webs can be effected rapidly when precise guidance of the free end of the new film as it unrolls to a location between the rollers of the draw-down device. The additional equipment required, by comparison to the prior art machine, is limited and does not contribute to a significant cost increase. Furthermore, the guiding principle used to carry the free end of the web to the draw-down device operates effectively independently of the width of the web or of the position of the roll from which it derives.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
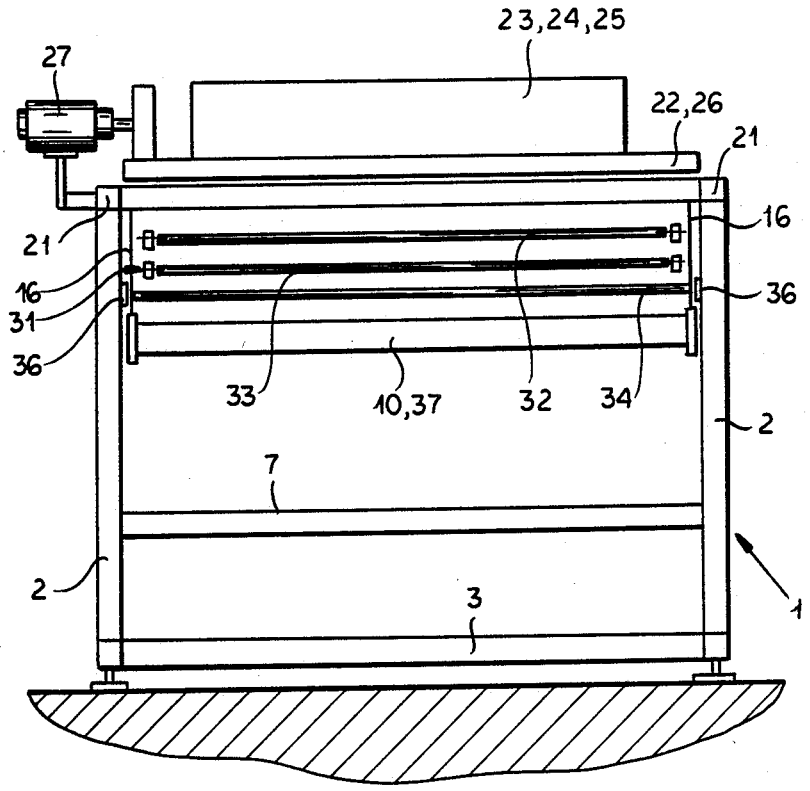
FIG. 1 is a front elevational view in highly diagrammatic form of a machine embodying the invention.

The machine shown in the drawing comprises a frame 1 formed with posts 2 and cross bars 3. At the front of the frame 1 I have provided a charging table 4 which can be in the form of a roller conveyor moving the cylindrical articles 5 in a direction 15 perpendicular to the plane of the paper in FIGS. 2–4. A deflector flap 6 is pivotal at the horizontal pivot 6a and is disposed between the charging table 4 and the wrapping zone or location of the machine in the region of the lower double-welding jaw member 7. The article 5 to be wrapped is located between the posts 2 shown in FIGS. 2–4 during the wrapping operation.

The lower double-jaw welding member 7 is disposed horizontally substantially at the level of the charging table 4 and at the level of the flap 6 when the latter is turned into the horizontal position (FIG. 2) for guiding a roll 5 to this location.

Juxtaposed with the fixed double-jaw welding member 7 is a double-jaw welding member 10 which is movable substantially vertically above the member 7 but, like member 7, is also horizontal.

Figure 5:
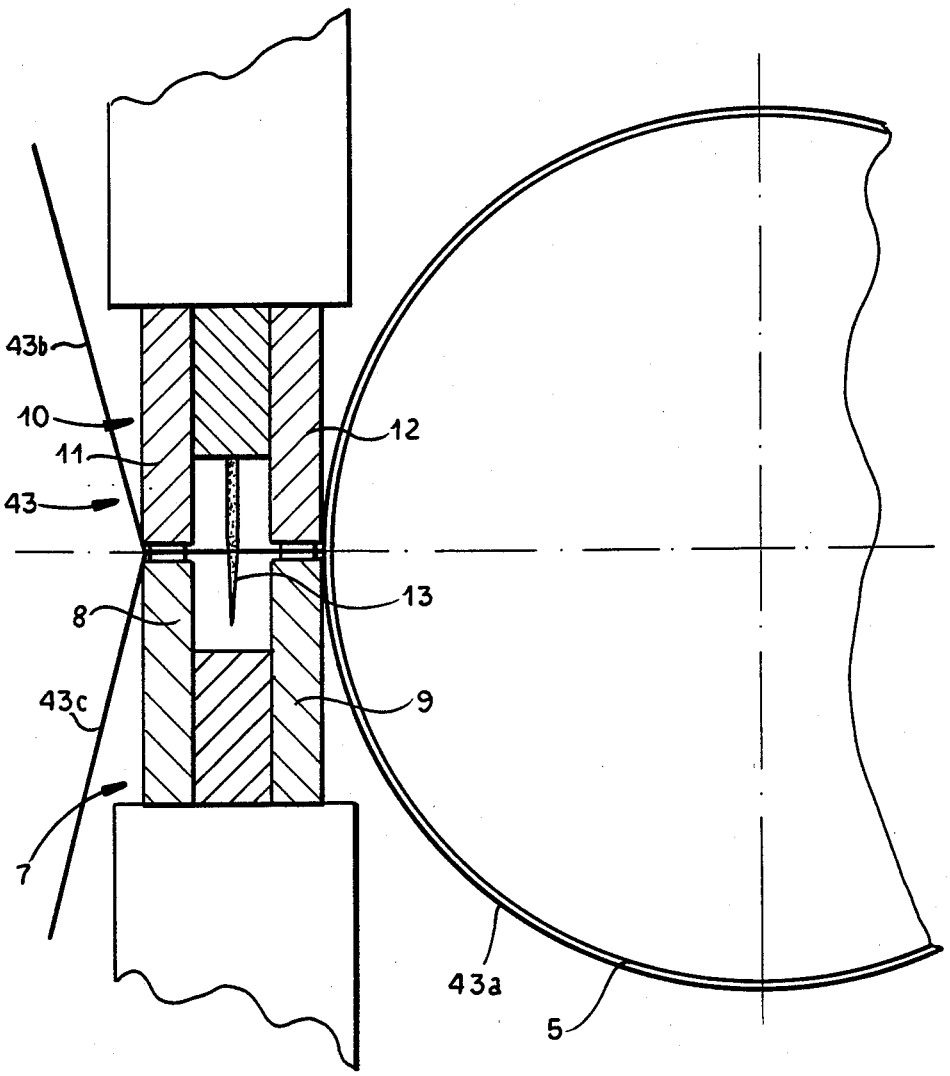
FIG. 5 is a detail sectional view, drawn to a much larger scale, illustrating the two double-jaw welding members of the invention.

As can be seen particularly from FIG. 5, the movable double-jaw welding member 10 comprises two welding electrodes 11 and 12 forming the respective jaws and, turned downwardly. These two electrodes being parallel to one another and disposed so as to cooperate respectively with the two electrodes 8 and 9 of the fixed-jaw member 7. A movable cutting tool or blade 13 is provided between the two electrodes 11 and 12 of the movable welding jaw.

Figure 2:
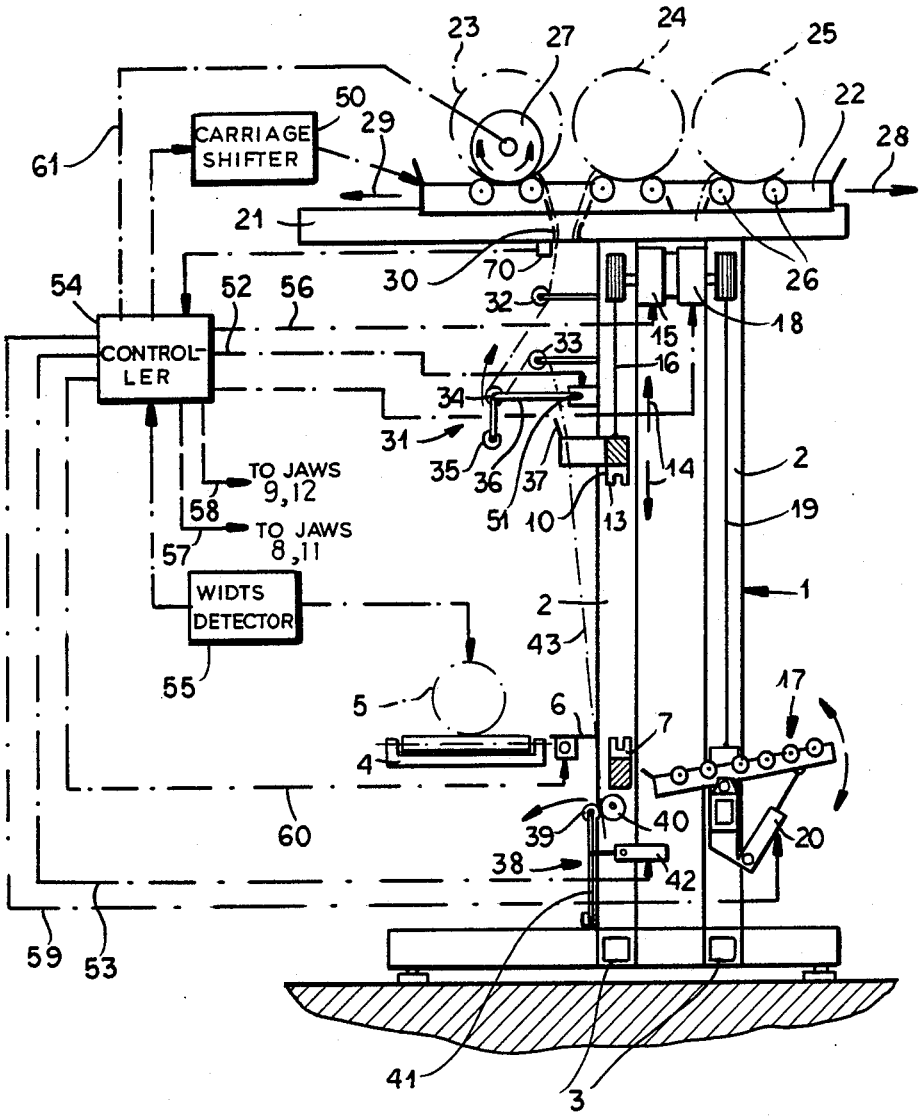
FIG. 2 is a side view of the machine of FIG. 1 in one operational stage during changeover of the web or film.

The movable double-jaw welding member 10 is displaceable vertically, as is shown by the double-headed arrow 14 in FIG. 2, with its displacement upwardly or downwardly being actuated by a motor 15 driving a windlass provided with the cable 16 on which the movable member 10 is suspended. The guides or rails for the member 10 on posts 2 at the opposite ends of the member 10 have not been shown.

Rearwardly of the vertical plane of the two welding members 7 and 10, I provide a pivotable roller table 17 receiving and supporting the cylindrical articles 5 during the envelopment thereof in the film 43, for example.

The rear table 17 is displaceable vertically by a windlass driven by a motor 18 and adapted to wind up or unwind cables 19 from which the table 17 is suspended.

The tilting of the rear table 17 about a horizontal axis parallel to the members 7 and 10 is effected by means of at least one pneumatic piston-and-cylinder device 10.

The vertical guide rolls for the rear table 17, likewise formed on posts 2 at opposite ends of the rear table 17, have also not been shown in the drawing.

The upper portion of frame 1 comprises horizontal beams 21 oriented from front to back and carrying a movable carriage 22. The carriage 22 is thus displaceable horizontally and serves to support 3 rolls 23, 24 and 25 of thermally weldable webs of different widths which are intended to wrap the products 5.

Each roll of the thermoplastic film or foil 23–25 is cradled on a pair of cylindrical supports or rolls 26 with parallel horizontal axes. Respective motors can be provided for rolling and unrolling the webs or a single motor can be provided for this purpose. This motor or these motors are represented by the motor 27 shown to be drivable in opposite senses as represented by the arrows in FIG. 2.

The assembly formed by the movable carriage 22 and the rolls of the film or foil 232–25 cradled thereon, is displaceable horizontally from front to rear or rear to front (see the arrow 28 and 29 in FIG. 2) under the control of a fluid-operated cylinder, not shown. However, the means for displacing the carriage is represented by the carriage shifter 50 also illustrated in block diagram form in FIG. 2.

The frame 1 is provided, on its upper portion, with a double-deflector 31, hereinafter referred to as a deflector roller or tensioning means, around which the web utilized for wrapping can pass in a plurality of loops, this web being supplied from one of the rolls 23, 24 and 25.

The upper part of the frame is also provided with a double deflector 30 for the web in use, this deflector receiving the web either from the roll 23 or the roll 24 or from the roll 24 and the roll 25.

When the web passes through the deflector 30, it can pass around two fixed rolls 32 and 33 of the tensioning device 31 and between two movable rollers 34 and 35 of the tensioning device, carried by the pivotal arm 36 in the form of a bell crank lever which is swingably mounted at 51. The actuator for this arm, not shown in detail in the drawing, may be another fluid-operated cylinder and has been represented by the dot-dash line 52 in FIG. 2.

A further deflector 37 is fixedly mounted on the double-jaw movable welding member 10 so that the web fed to the wrapping location passes between the jaws of member 10 and the deflector 37.

At the bottom of the frame, below the fixed-jaw member 7, a draw-down device 38 is provided. This device is formed by two rollers 39 and 40 which can grip the web between them. The roller 39 is carried by a pivotal arm 41 displaceable by a fluid-operated cylinder 42 supplied at 53 by the controller 54 (FIG. 2).

The lengths of the cylindrical products 5 which are fed in succession to the feeding table 40 detected automatically by a detection means represented at 55 supply a signal to the controller 54 signalling the nature of any web change which is required. In other words, depending upon the length of the article to be wrapped, an automatic selection is affected of one of the three web rolls 23, 24 and 25 which is to supply the web to the wrapping location.

If two or more articles 5 have the same length and are to be successively wrapped, they will be wrapped in the same web 43 unrolled from one of the rolls 23–25, e.g. the roll 23 as shown in FIG. 2. Each cylindrical article 5 is then pushed perpendicularly to the web 43 which initially forms a screen held taut between the tension device and the draw-down device 38 so that as the article 5 is pressed past the plane of the screen onto the rear table 17, the web envelopes the article.

This action is coordinated with a loading of the upper member 10 by the controller 54 through the control input 56 to the motor 15.

The portion 43a thus wraps around the article until a complete sheath is formed therearound and the ends of this sheath are joined by welding between the members 7 and 10 as shown in FIG. 5.

The corresponding electrodes 8, 11 and 9, 12 engage the two adjoining portions of the web terminating the sheath 43a around the article 5 along respective parallel strips and the electrodes are energized to form respective weld seams along these strips. Simultaneously, the blade 13 slices through the web between the weld seams.

The electrodes 8, 10 are energized by the controller 54 via the control path 57 while the electrodes 9 and 12 are independently energized via the control path 58 as diagrammatically represented in FIG. 2.

Because the weld is formed between the trailing portion 43b of the web still connected to the roll 23 and the leading portion 43c held between the rollers 39 and 40, the screen formed by the web is reshaped upon cutting through of the web between the weld seam and, after the wrapped article has been discharged by tilting of the table 17 by the controller 54 via the signal path 59, the next article to be wrapped can be fed in the manner described.

However, if the detector 55 detects an article 5 of a different length after the wrapping of a previous article in the web 43, the controller 54 initiates a switchover to a web of a correspondingly different width.

Figure 3:
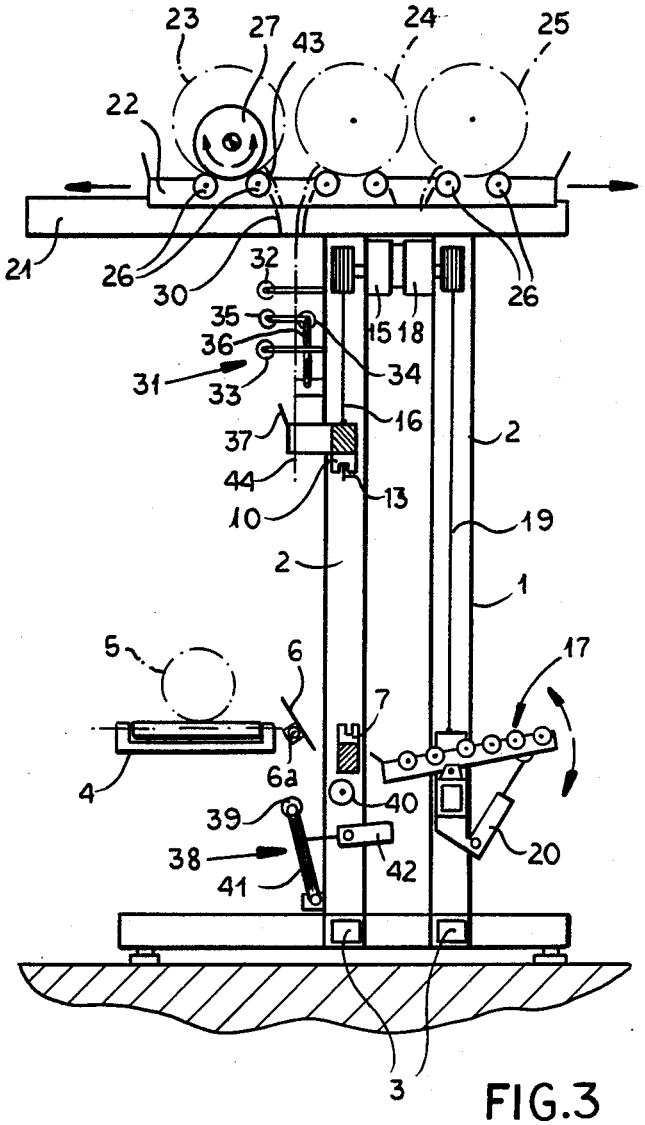
FIGS. 3 and 4 are views similar to FIG. 2 illustrating two other functional steps in the changeover operation.
Figure 4:
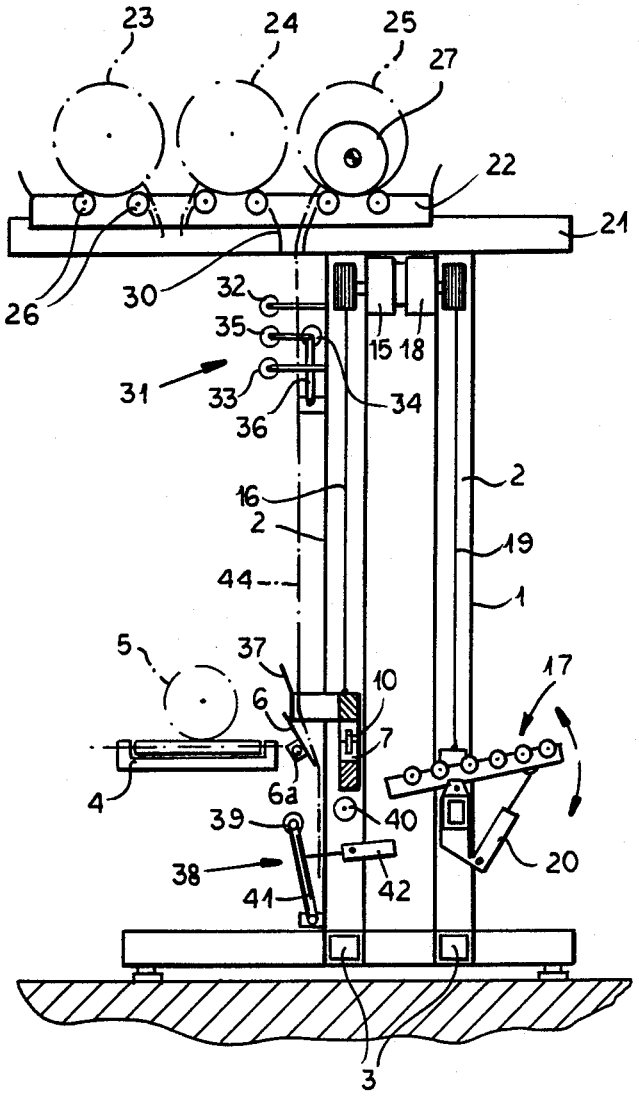

For example, for the successive article, the web fed from the intermediate roll 24 may be necessary (FIG. 3) or from the rear roll 25 (see FIG. 4).

In this case, following the wrapping of the preceding article 5, only the electrodes 9 and 12 are energized to close the sheath 43*a* surrounding the article while the electrodes 8 and 11 are not energized so that they only clamp the web while the plate 13 cuts between the strips.

The two portions 43*b* and 43*c* of the web are thus not joined at a weld seam and when member 10 is again raised, the web portion 43*c* will fall to the floor of the machine and can be discarded as waste while the portion 43*b* will constitute a free end.

The controller 54 then opens the clamping device 38 by displacing the roller 39 via the cylinder 42. Simultaneously, the deflector flap 6 controlled by an actuator 60 operated by the controller 54, is swung in the clockwise sense to the tilted position shown in FIGS. 3 and 4.

The movable rollers 34 and 35 of the tensioning or length compensating device 31 are raised by swinging the arm 36 in the clockwise sense (compare FIG. 2 with FIGS. 3 and 4).

Motor 27 is driven by the controller 54 via the control signal 61 to wind up the free end 43*b* of the web. Simultaneously, member 10 is raised by the controller.

The carriage 22 is then shifted if necessary or, as is apparent from FIG. 3, another web 44 is unrolled with a different width from that of the web which has been rolled up.

If this web 44 derives from the middle roll 24, it is not necessary to displace the carriage 22 (FIG. 3).

However, if the new web 44 derives from the rear roll 25, the carriage 22 is displaced to the left (FIG. 4).

In order to unroll the web 44, the respective motor 27 is energized at 61 so that the free end of this web 44 will descend and pass through the double deflector 30 and between the rolls of the tensioning and length-compensating roller arrangement 31.

The free end of the web 44 is thus located between the movable member 10 and the deflector 37 carried thereby and previously raised. As the web 34 is lowered, the controller 54 lowers the movable member 10 and the deflector 37 so that they accompany the descent of the free end of the web.

When the member 10 reaches the fixed member 7, the member 10 is halted while the web 44, still guided by member 37, continues its descent until it passes between the tilted deflector and the fixed member 7 and then between the rollers 39 and 40 of the clamping device 38 (FIG. 4).

The deflector 6 is swung back into its horizontal position and the clamp 38 is closed. The movable member 10 is raised and the device 31 has its arm 36 swung outwardly to its original position.

The new web 44 thus forms a screen held at its lower end by the clamp 38 and the machine is prepared to wrap the first product 5 of different length in this new web 44 of corresponding width.

The changeover sequence is thus effected entirely automatically with appropriate control means well known in the art. A photo-electric cell, for example, can detect the arrival of this upper position of the rewound web 43, a delay in feeding the new web 44 can ensure that the previously wound web is fully rerolled, and similar automatic means can control the various steps of the process as illustrated and described.

It will be appreciated that the invention is not limited to the wrapping of purely cylindrical products but can be used for wrapping products which have generally cylindrical, i.e. elongated and generally axial symmetrical shapes.

I claim:

1. A machine for wrapping an elongated, generally cylindrical article in a thermally weldable web, said machine comprising:

a support;

means on an upper portion of said support for holding a plurality of rolls of a thermally weldable web;

means below said upper portion for feeding generally cylindrical articles in succession to a wrapping location;

a lower double-jaw welding member mounted fixedly on said support at said location;

an upper double-jaw welding member mounted for vertical movement on said support and juxtaposed with said lower member so that upon movement of said upper member toward said lower member pairs of jaws of said members clamp said web between them at two spaced apart strips;

means for selectively energizing at least one of said jaws of each pair individually and together to form selectively two welds along the respective strip and a single weld along a respective one of said strips proximal to an article being wrapped;

cutting means on one of said members for cutting said webs between said strips;

deflecting-roll means on said support between said upper portion and said location around which said web can pass to said location;

drawing means on said support below said location for engagement with said web for holding same across a path of said articles between said means for feeding and said lower member; and means on said support at said location for receiving and supporting each article in the course of wrapping same, whereby said web is deflected around each article as it is displaced between said members from said means for feeding onto said means for receiving and supporting, whereby two welds are formed at said strips and the web is cut between said welds when the web from one of said rolls is to wrap a succession of said articles, but only a single weld is formed at one of said strips proximal to an article being wrapped and the web is cut between the strips when a successive article is to be wrapped with the web from another one of said rolls.

2. The machine defined in claim 1, further comprising a deflector on said upper double-jaw welding member and movable therewith for guiding a free end of a web during changeover from one web to another as said free end of said web is supplied to said drawing means.

3. The machine defined in claim 1, further comprising a movable deflector flap disposed between said means for feeding and said lower double-jaw welding member, said flap being positioned in a tilted orientation during changeover of webs.

4. The machine defined in claim 1 wherein said deflecting-roll means includes at least one movable roller displaceable from a position in which a web is looped around said roller to a position in which a web can pass freely through said deflecting-roll means for changeover of said web.

5. The machine defined in claim 1 wherein said means on said upper portion of said support for holding said plurality of rolls includes a horizontally movable carriage and at least one motor operatively connectable with at least one of said rolls of thermally weldable web for unrolling web therefrom and rerolling said web thereon.

6. The machine defined in claim 1, further comprising means for automatically detecting lengths of articles arriving at said means for feeding, and control means connected to said means for detecting for sequencing web changeover of the machine.

7. The machine defined in claim 6, further comprising a photoelectric cell for detection of the arrival at an upper position of a rerolled web during changeover of webs.

* * * * *